United States Patent [19]

Sawyer

[11] 4,239,173

[45] Dec. 16, 1980

[54] CONCRETE CONSTRUCTION FORM AND TIE ROD

[76] Inventor: Robert D. Sawyer, 10308 W. Bluemound Rd., Apt. 220, Wauwatosa, Wis. 53226

[21] Appl. No.: 895,747

[22] Filed: Apr. 13, 1978

[51] Int. Cl.[3] ..... E04G 17/08

[52] U.S. Cl. ..... 249/41; 249/40; 249/45; 249/190; 249/191; 249/192; 249/214; 249/218

[58] Field of Search ..... 249/40, 41, 45, 189, 249/190, 192, 191, 214, 218; D8/384, 385

[56] References Cited

U.S. PATENT DOCUMENTS

| | | | |
|---|---|---|---|
| 1,491,413 | 4/1924 | Orlopp et al. | 249/214 |
| 1,905,051 | 4/1933 | Podd | 249/41 |
| 3,362,678 | 1/1968 | Bowden | 249/41 |
| 3,653,628 | 4/1972 | Showemaker | 249/214 |

FOREIGN PATENT DOCUMENTS

| | | | |
|---|---|---|---|
| 991423 | 5/1965 | United Kingdom | 249/214 |

*Primary Examiner*—James H. Derrington
*Attorney, Agent, or Firm*—Michael, Best & Friedrich

[57] ABSTRACT

An improved concrete form and tie rod, the concrete form and tie rod being constructed to facilitate disassembly of concrete form assemblies. The tie rods and concrete forms and structured to permit the ends of the tie rods to be broken off following completion of the concrete casting process to thereby facilitate removal of the aligning pins which hold the concrete forms of a form assembly together.

7 Claims, 7 Drawing Figures

CONCRETE CONSTRUCTION FORM AND TIE ROD

BACKGROUND OF THE INVENTION

1. Field of the Invention

The present invention relates to forming or casting concrete and more particularly to concrete construction forms and tie rods used to hold such concrete construction forms in parallel spaced apart relationship. The invention further relates to concrete construction forms and tie rods which facilitate disassembly of form assemblies following the construction process.

2. Description of the Prior Art

Concrete walls are poured or cast between parallel spaced apart assemblies of concrete construction forms. The concrete construction forms generally comprise rigid generally planar structures usually comprised of wood, aluminum, iron, steel or combinations of these materials, the concrete forms each having a planar forming surface and being assembled in mutually coplanar relationship to form a continuous concrete forming surface. The forms are joined together by pins extending through the end walls of the forms and a wedge is forced into a longitudinal slot in the end of the pins such that the forms can be held securely in adjacent relation.

Poured concrete walls are formed by positioning two such concrete form assemblies in spaced apart parallel relation wherein concrete can be poured therebetween. The form assemblies are held in the correct spaced apart relationship by the tie rods extending between the form assemblies, the respective opposite ends of these tie rods being secured between concrete forms of the concrete form assemblies. The tie rods commonly include holes in their ends whereby the pins used to join the forms together can extend through the holes in the ends of the tie rods to secure the ends of the tie rods.

Following the concrete pouring process and after the concrete has hardened, the forms are disassembled for reuse. The wedges are pounded out of the respective slots in the ends of the pins, and the pins are pounded out of the holes in the end walls of the forms to thereby permit separation of the forms. The forms can then be removed leaving the tie rods embedded in the poured wall.

During the concrete pouring process, the wet concrete exerts static force on the forms, in turn causing the pins to exert a force on the tie rods. During disassembly of the forms, the force of the pins against the tie rods makes removal of the pins difficult. Normally the ends of the pins must be struck repeatedly with a heavy hammer to drive the pins out of the holes in the concrete form end walls.

SUMMARY OF THE INVENTION

The present invention provides an improved concrete construction form and tie rod which facilitate relatively easy disassembly of the concrete forms thereby providing labor cost savings and also preventing damage to the forms. The tie rod and concrete construction forms are particularly constructed such that the ends of the tie rods may be broken off adjacent the pin joining the concrete forms together. Accordingly, the forces on the pin are substantially removed and the pin may then be easily removed from the forms and the forms disassembled.

The tie rod of the present invention generally comprises a planar metal bar having bores in its opposite ends for receiving the pins joining adjacent forms. The opposite ends of the tie rods also have notches formed in their edges to thereby form a cross-sectional area through the ends of the rods of reduced thickness and in a plane transverse to the longitudinal direction of the tie rods and generally bisecting the bores. The ends of the tie rods are received in grooves formed in the side, top or bottom walls of the concrete forms. The grooves include a flared portion adjacent the rear face of the concrete form to permit movement of the end of the tie rod between the concrete forms and closely adjacent the pin joining the forms together, to thereby allow the ends of the tie rod to be broken off in the plane extending through the hole in the tie rod. By breaking the tie rods at this point, the forces of the tie rods on the concrete form aligning pins are removed and the aligning pins can be easily removed during disassembly of the concrete form assemblies thereby providing a substantial labor and cost savings.

DESCRIPTION OF THE PREFERRED EMBODIMENT

Figure 1:
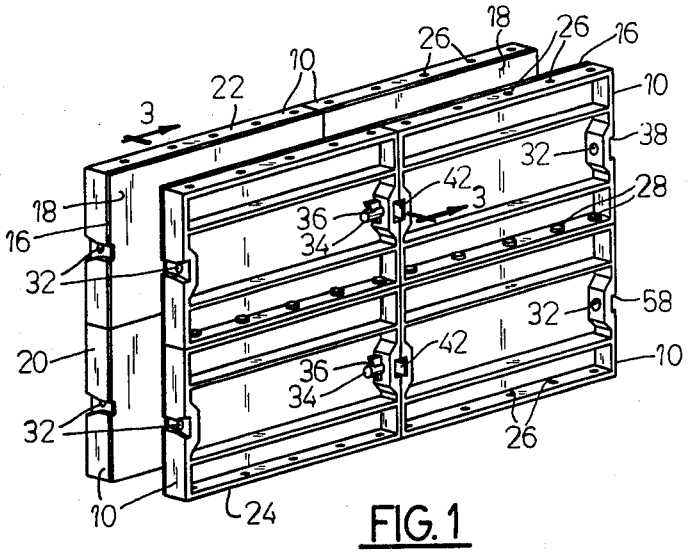
FIG. 1 is a perspective view of a plurality of assembled concrete forms held in spaced apart relation by tie rods embodied by the present invention.

A plurality of concrete wall forms 10 are illustrated in FIG. 1 as being rigidly joined together in coplanar relationship to comprise a concrete form assembly 12, the concrete form assembly 12 positioned in opposed parallel spaced apart relationship from a second concrete form assembly 14 also comprised of coplanar forms 10. The concrete form assemblies 12 and 14 define a concrete pouring space therebetween.

The concrete forms 10 generally define a rigid structure including a planar face sheet 16 providing a concrete forming surface 18 and a supporting structure 20 backing the face sheet 16 and intended to prevent bending of the face sheet 16 when concrete is poured between the assembled concrete forms 10.

Figure 4:
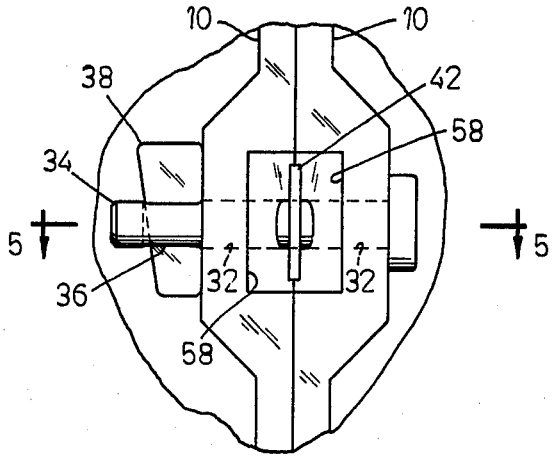
FIG. 4 is an enlarged partial elevation view of the concrete construction forms shown in FIG. 1.
Figure 5:
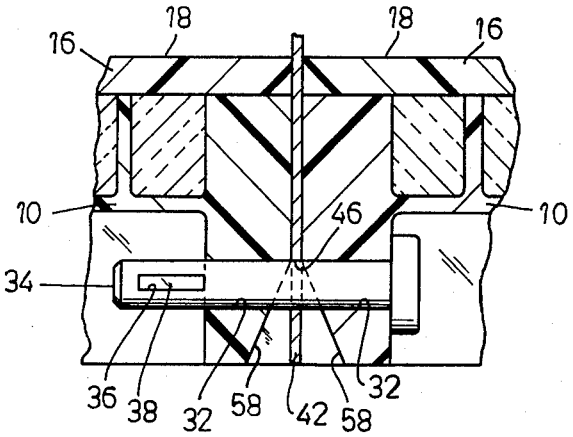
FIG. 5 is a cross-section view taken along line 5—5 in FIG. 4.

The concrete form assemblies 12 are intended to be assembled in situs. Accordingly, the top and bottom walls 22 and 24, respectively, of the forms 10 each include a plurality of bores 26 for receiving bolts 28 so that a pair of forms 10 can be held together in vertically stacked relation. The concrete forms 10 also include planar vertical side walls 30 which extend rearwardly and which have a central bore 32 therethrough for receiving a pin 34. Two adjacent concrete forms 10 can be secured together with their vertical side walls 30 in abutting relationship and with their faces in coplanar alignment by the pin 34 received through the aligned bores 32 in the vertical side walls 30 of the concrete forms 10. As shown in FIGS. 1, 4 and 5, the pin 34 is provided with a central slot 36 therethrough in one of its ends for receiving a wedge 38 therein. The wedge 38 can be forced into the slot 36 and is positioned against an inside face 40 of the side wall 30 to draw the adjacent side walls 30 of the two adjacent forms 10 together.

Figure 2:
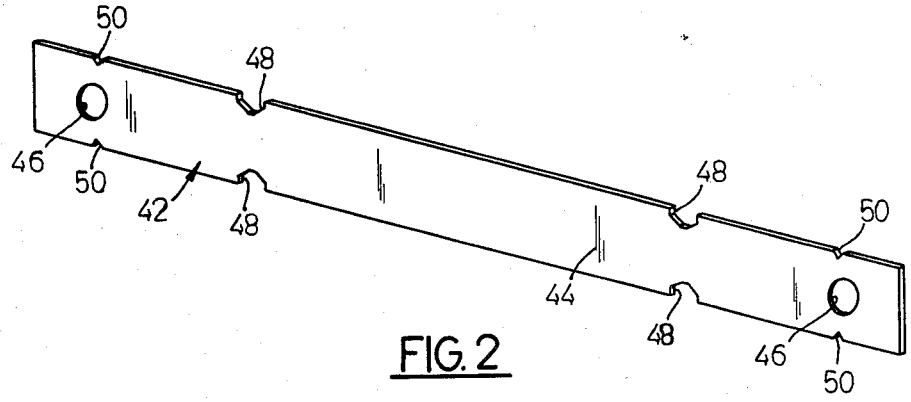
FIG. 2 is an enlarged perspective view of a tie rod of the invention.
Figure 3:
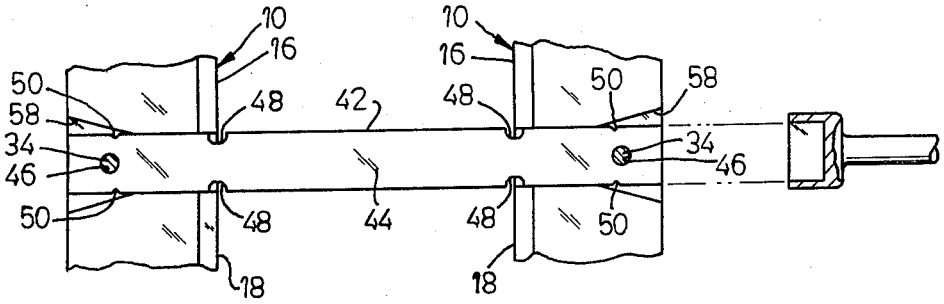
FIG. 3 is a partial cross-section view taken along line 3—3 in FIG. 1 and showing a partial cross-section view of a tool receivable on an end of a tie rod according to the invention for removing the end of the tie rod.

To maintain the concrete form assemblies 12 in properly spaced relation with respect to an opposed parallel concrete form assembly 12, tie rods 42 of the invention extend transversely between the two form assemblies 12 as shown in FIGS. 1 and 3. The tie rods 42 are shown more clearly in FIG. 2 and generally comprise an elongated thin metal bar having opposed planar faces 44. Holes 46 extend through each of the opposite ends of the metal bar, the holes 46 each having an axis transverse the faces 44 of the bar. The holes 46 are adjacent but spaced from the respective ends of the bar. The bar includes two pairs of notches 48 and 50, respectively, in the edges of the bar, the notches 48 and 50 being mutually spaced apart and disposed between the holes 46. As shown in FIG. 3, the pairs of notches 48 are disposed adjacent the planes defined by the respective faces 18 of the concrete forms 10. When concrete is poured between the concrete form assemblies 12 and has cured, and the forms 10 have been removed, the tie rods 42 remain imbedded in the poured concrete wall. The pairs of notches 48 permit the ends of the tie rods 42 protruding from the concrete wall to be broken off in a manner to be described such that the tie rods 42 do not extend outwardly beyond the faces of the concrete wall.

The tie rods 42 also include an area of reduced thickness adjacent each of the holes 46 formed by the pairs of notches 50 in the edges of the tie rod 42. The notches 50 lie in a plane generally extending transversely to the longitudinal axis of the tie rod 42 and through the hole 46 adjacent its center.

Figure 6:
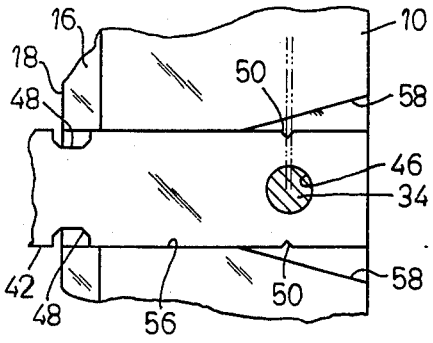
FIG. 6 is an enlarged partial view of the tie rod and concrete form shown in FIG. 3.
Figure 7:
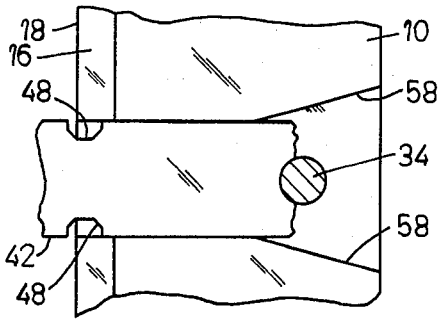
FIG. 7 is a view similar to FIG. 6 but showing the end of the tie rod removed.

As shown in FIGS. 6 and 7, the area of reduced thickness through the end of the tie rod facilitates breaking of the tie rod along a plane extending through the hole 46. When the tie rod 42 is broken in this manner, removal of the pin 34 is facilitated, thereby permitting the concrete forms 10 to be disassembled. When concrete is poured into the cavity between the form assemblies, the static pressure of the concrete tends to force the forms outwardly. The concrete forms 10 are restrained against such outward movement by the tie rods 42, the tie rods applying a force on the pins 34.

In an alternative embodiment of the invention, the tie rods 42 could be provided with linear grooves in one or both of the planar faces and in a plane generally bisecting the hole 46 and extending transversely to the longitudinal direction of the tie rod. Such grooves would function like the notches 50 to provide a region of reduced cross-sectional area in the plane bisecting the holes 42 to facilitate fracture of the tie rod in that plane. Such grooves could be provided to replace the notches 50 or could be used in combination with the notches 50. As an additional alternative, the area of reduced thickness could be provided by a series of linearly aligned holes through the tie rod and lying in the plane of reduced thickness.

As shown in FIG. 6, the center line of the notches 50 is offset a small distance from the plane bisecting the hole 46 in that end of the tie rod 42 and in a direction away from the end of the tie rod 42 to further facilitate removal of the pin 34.

During the concrete pouring process, the opposite ends of the tie rods 42 are respectively positioned between adjacent planar vertical side walls 20 of two juxtapositioned concrete wall forms 10 and are received within mating grooves 52 formed in the planar side walls 20. The grooves 52 extend perpendicular to the plane of the face plate 16 and from the concrete forming surface 18 to the rear surface of the concrete forms 10. As shown in FIG. 1, the grooves 52 are disposed generally equidistant the ends of the vertical side walls 20 of the forms 10. That portion of the vertical side walls 20 surrounding the groove 52 is substantially thicker than the remainder of the vertical side wall to increase the strength of the side wall 20 in that area.

The grooves 42 include a shallow portion 56 adjacent the concrete forming surface 18 and a flared portion 58 extending from said shallow portion 56 to the rear edge of the vertical side wall 20. The shallow groove portion has a width closely approximating the width of the tie rod 42 and a depth approximating half the thickness of the tie rid 42. The flared portion 58 of the groove includes side walls 60 and 62 which diverge outwardly toward the rear edge of the vertical side wall such that groove 52 is substantially wider adjacent the rear edge of the vertical side wall 20. Similarly, as shown in FIGS. 4 and 5, the depth of the flared portion 58 of the groove 52 increases toward the rear edge of the vertical side wall 20.

The bores 32 in the vertical side walls extend through the flared portion 58 of the groove but are spaced from the rear edge of the vertical side wall 20.

Referring to FIGS. 4 and 5, it will be seen that the flared portions 58 of the grooves 52 permit the end of the tie rod 42 to be bent or twisted to thereby permit it to be broken off in the manner shown in FIG. 7. Such bending of the end of the tie rod 42 can be accomplished using a tool 60 as shown in cross-section in FIG. 3. Such a tool 60 has an end receivable within the flared portions 58 of grooves 52 of adjacent concrete forms 10. That end of the tool includes a slot 62 for housing the end of tie rod 42 and the opposite end of the tool functions as a lever whereby the end of the tie rod 42 can be bent or twisted such that it can be broken along the plane passing through the hole 46.

I claim:

1. In combination: a concrete construction form for use in casting concrete, said concrete construction form having opposed faces, one of said faces defining a concrete forming surface, a top wall, a bottom wall, and planar vertical side walls, said side walls including front and rear edges and one of said side walls including a groove extending transverse to said edges and therebetween, and a bore in said groove through said vertical side wall, said bore having an axis generally parallel to said opposed faces, and said groove having a flared portion from said bore toward said rear edge; and a tie rod comprising an elongated, thin, planar metal bar having opposed faces, edges and opposite ends, and having a hole extending through at least one of said opposite ends and transverse to said opposed faces, and said bar having a reduced thickness in a plane extending transverse to the longitudinal axis of said bar and extending through one of said holes whereby said tie rod can be fractured along said plane by twisting the end of said bar, said at least one of said opposite ends positioned in said groove with said hole in said tie rod coaxially aligned with said bore, and with an end portion of said one of said ends extending into said flared portion of said groove.

2. The combination set forth in claim 1 wherein said flared portion of said groove includes a groove floor and opposed groove side walls, and wherein said groove floor defines an acute angle with said one of said side walls and slopes away from said one of said side walls toward said rearward edge.

3. The combination set forth in claim 1 wherein said flared portion of said groove includes a groove floor and opposed groove side walls, and wherein said groove side walls diverge from said bore toward said rear edge.

4. The combination set forth in claim 1 wherein said tie rod includes at least one notch in one of said edges, said notch generally lying in said plane.

5. The combination set forth in claim 1 wherein said tie rod includes a groove in at least one of said faces, said groove lying in said plane.

6. The combination set forth in claim 1 wherein said plane generally bisects said hole.

7. The combination set forth in claim 2 wherein said tie rod includes at least one notch in one of said edges, said notch generally lying in said plane.

* * * * *